US007264417B1

(12) United States Patent
Nasatka

(10) Patent No.: US 7,264,417 B1
(45) Date of Patent: Sep. 4, 2007

(54) VEHICLE BARRIER SYSTEM, AND RELATED METHOD

(75) Inventor: Kenneth F. Nasatka, Huntingtown, MD (US)

(73) Assignee: Nasatka Barrier, Inc., Clinton, MD (US)

( * ) Notice: Subject to any disclaimer, the term of this patent is extended or adjusted under 35 U.S.C. 154(b) by 0 days.

(21) Appl. No.: 11/386,687

(22) Filed: Mar. 23, 2006

(51) Int. Cl.
*E01F 13/00* (2006.01)
*E01F 13/04* (2006.01)
*E01F 13/08* (2006.01)

(52) U.S. Cl. ..... 404/6; 404/9

(58) Field of Classification Search ..... 404/6–10, 404/11, 12; 49/49
See application file for complete search history.

(56) References Cited

U.S. PATENT DOCUMENTS 4,333,268 A 6/1982 Dumbeck
4,490,068 A * 12/1984 Dickinson ..... 404/6
4,574,523 A 3/1986 Nasatka
4,576,507 A 3/1986 Terio
4,577,991 A * 3/1986 Rolow ..... 404/6
4,630,395 A 12/1986 Nasatka
4,681,479 A 7/1987 Wagner et al.
4,739,302 A 4/1988 Kinard
4,752,152 A * 6/1988 Crisp et al. ..... 404/6
4,775,261 A 10/1988 Fladung
4,818,136 A 4/1989 Nasatka et al.
4,826,349 A 5/1989 Nasatka
4,828,424 A * 5/1989 Crisp, Sr. ..... 404/6
4,850,737 A 7/1989 Nasatka et al.
4,893,119 A * 1/1990 Nasatka ..... 340/928
4,916,859 A * 4/1990 Butler ..... 49/9
4,919,563 A 4/1990 Stice
4,934,097 A * 6/1990 Quante ..... 49/49
4,941,284 A 7/1990 Stoller
4,989,835 A * 2/1991 Hirsh ..... 256/13.1
5,228,237 A 7/1993 Nasatka
5,267,808 A * 12/1993 Welford ..... 404/11
5,288,164 A 2/1994 Nasatka
5,466,088 A * 11/1995 Nasatka ..... 404/6
5,639,178 A * 6/1997 Wilson et al. ..... 404/6
6,010,277 A * 1/2000 Follman ..... 404/11
2004/0194387 A1 10/2004 Hom et al.
2005/0214072 A1* 9/2005 Turpin et al. ..... 404/6
2005/0220536 A1* 10/2005 Blair et al. ..... 404/6

* cited by examiner

*Primary Examiner*—Raymond Addie
(74) *Attorney, Agent, or Firm*—Berenato, White & Stavish

(57) ABSTRACT

A vehicle barrier system is provided, which features a security barricade, a hydraulic actuator for moving the barricade between open and closed positions, a pump, a DC motor for operating the pump, and a controller. In a first embodiment, the system features a rechargeable battery for powering movement of the barricade between the open and closed positions in normal operation mode, and a hydraulic accumulator for effecting movement of the barricade from the open to closed position in emergency operation mode. According to a second embodiment, the system features a rechargeable primary battery for powering movement of the barricade in normal operation mode, and a rechargeable secondary battery for effecting movement of the security barricade from open to closed position in emergency operation mode.

22 Claims, 6 Drawing Sheets

VEHICLE BARRIER SYSTEM, AND RELATED METHOD

FIELD OF THE INVENTION

The present invention relates to vehicle barrier systems and, more particularly, to battery-powered vehicle barrier systems preferably having emergency actuation capabilities.

BACKGROUND OF THE INVENTION

Vehicle barrier systems are commonly used for preventing the passage of a vehicle or traffic along a vehicle pathway, such as a road or driveway. Signal barriers such as gate arms act as signalers, instructing the vehicle driver to halt and await clearance before proceeding through a checkpoint area. Signal barriers are limited in effectiveness, however, insofar as a moving vehicle can crash through the gate arm without disabling the vehicle. Hence, signal barriers do not physically restrict access to an area, but generally merely act as warning devices and deterrents.

Vehicle barrier systems that function as barricades are disclosed in, for example, U.S. Pat. Nos. 5,466,088, 4,574,523 and 4,630,395. These barricades are low lying in the roadway and moveable from a generally horizontal position to an angularly disposed position for blocking the passage of a vehicle along the roadway. The barricades may be used alone or in combination with a signal barrier, such as a gate arm, as shown in U.S. Pat. No. 5,466,088. An advantage to the use of barricades over signal barriers is that the barricades are constructed to absorb the impact force created by the collision of a vehicle therewith, thereby preventing the progress of the vehicle past the barricade. Barricades are especially effective as both deterrents and impediments against terrorists and other hostile individuals intent on transporting a vehicle carrying armed personnel or explosives next to or into a building, e.g., for the purpose of permitting the personnel to swiftly infiltrate the building or detonating the explosives with optimal destructive effect to the building and its occupants. As a consequence, barricades have become common defensive equipment at such facilities as oil refineries, satellite communication stations, embassies, military bases, and other government installations.

The vehicle barrier systems disclosed in the aforementioned patents generally feature a barricade operated by a controller to move between open and closed positions. In the open position, the barrier is lowered so as not to impede the passage of vehicle traffic along a vehicle passageway, such as a road, thoroughfare, private access way, driveway, etc. In the closed position, the barrier is raised to physically obstruct vehicle movement.

The barrier systems include an actuator system connected to the barricade for moving the barricade between its open and closed positions. The actuator system typically features hydraulics, such as a piston and rod assembly, for raising and lowering the barricade. A motor drives the actuator to move the barricade between the open and closed positions. The motor is operatively connected to a barrier controller, which controls operation of the barrier and is operated automatically or manually, such as by a security guard or other authorized personnel. Oftentimes the barricade is retained in its closed, raised position until such time as vehicle occupants seeking to traverse the barricade present proper identification or authorization to proceed. The security guard will then activate the barrier controller to lower the barricade. Alternatively, in high traffic areas and the like, the security guard may retain a barricade in its open, lowered position until such time as the guard perceives an imminent threat, such as a hostile vehicle approaching the barricade at high speed without manifesting an intention to stop at the checkpoint.

Generally, the girth and massive weight of vehicle barricades are responsible for the relatively slow rates at which barricades can be raised from their open position to their closed position. Accordingly, a security guard must be vigilant in observing for hostile behavior so as to act to raise the barrier before a hostile vehicle may traverse the lowered barricade. A moment of inattention or distraction can in some cases afford enough of a time window to permit the hostile vehicle to bypass the security barricade before it is raised to a sufficient height to obstruct passage.

It is known to equip a hydraulic actuator system with an accumulator to permit the barricade to be raised at a faster than normal operation rate for emergency situations. An alternating current electric power source is used to operate a pump and cause pressurized hydraulic fluid to store in the accumulator. Upon activation of an emergency switch, the stored pressurized hydraulic fluid is charged from the accumulator into the hydraulic actuator, which raises the barricade into the closed position at a faster than normal operation rate, before an unauthorized vehicle can traverse the barrier system.

Although hydraulic accumulators generally are adequate for raising the barrier in emergency situations, if not operated and maintained properly accumulators can malfunction or function at less than optimum levels. For example, improper maintenance or use, such as in the case of a foreign object becoming trapped in and obstructing the movement of the barrier mechanical system, can generate back pressure in the hydraulic system and compromise pressure seals of the hydraulic accumulator. Further, disruption of electric power to the barrier system, for example in the case of a power failure or an attack by a terrorist on a supplying power source, can deleteriously affect the normal and emergency operations of the barricade.

SUMMARY OF THE INVENTION

It is an object of the invention to provide a vehicle barrier system operable in emergency mode for raising its security barricade at a faster than normal operating rate, while overcoming the drawbacks of conventional accumulator systems.

In accordance with the purposes of the invention as embodied and broadly described herein, a first aspect of the invention provides a vehicle barrier system that is positioned or capable of being positioned in a vehicular passageway for permitting selective obstruction of the vehicular passageway to vehicle traffic and the like. The vehicle barrier system features a security barricade movable between an open position for permitting passage of a vehicle through the vehicle barrier system and a closed position for obstructing passage of the vehicle through the vehicle barrier system, a hydraulic actuator system operatively connected to the security barricade for moving the security barricade between the open and closed positions, a pump for supplying hydraulic fluid to the hydraulic actuator system, a DC motor for operating the pump, and a controller for controlling activation of the DC motor. The system further features a battery for supplying sufficient power to the DC motor in normal operation mode to operate the pump in a manner that causes the actuator to move the security barricade between the open and closed positions at a first operating speed. A hydraulic accumulator is also provided for storing pressurized hydraulic fluid that may be supplied to the hydraulic actuator system in emergency operation mode for, either alone or in combination with hydraulic fluid supplied from the pump, moving the security barricade between the open and closed positions at a second operating speed which is greater than the first operating speed.

A second aspect of the invention provides a vehicle barrier system positioned or capable or being positioned in a vehicular passageway for permitting selective obstruction of the vehicular passageway to vehicle traffic or the like. The vehicle barrier system features a security barricade movable between an open position for permitting passage of a vehicle through the vehicle barrier system and a closed position for obstructing passage of the vehicle through the vehicle barrier system. The system further features a hydraulic actuator system operatively connected to the security barricade for moving the security barricade between the open and closed positions, a pump for supplying hydraulic fluid to the hydraulic actuator system, a DC motor for operating the pump, and a controller for controlling activation of the DC motor. The system includes primary and secondary batteries. The primary battery supplies sufficient power to the DC motor in normal operation mode to operate the pump in a manner that causes the actuator to move the security barricade between the open and closed positions at a first operating speed. The secondary battery supplies auxiliary power to the DC motor in emergency operation mode such that the auxiliary power, alone or in combination with the power supplied by the primary battery, is sufficient to operate the pump in a manner that causes the actuator to move the security barricade between the open and closed positions at a second operating speed which is greater than the first operating speed.

Other aspects of the invention relate to methods of using the vehicle barrier system.

BRIEF DESCRIPTION OF THE DRAWINGS

The accompanying drawings are incorporated in and constitute a part of the specification. The drawings, together with the general description given above and the detailed description of the preferred embodiments and methods given below, serve to explain the principles of the invention. In such drawings.

Figure 1:
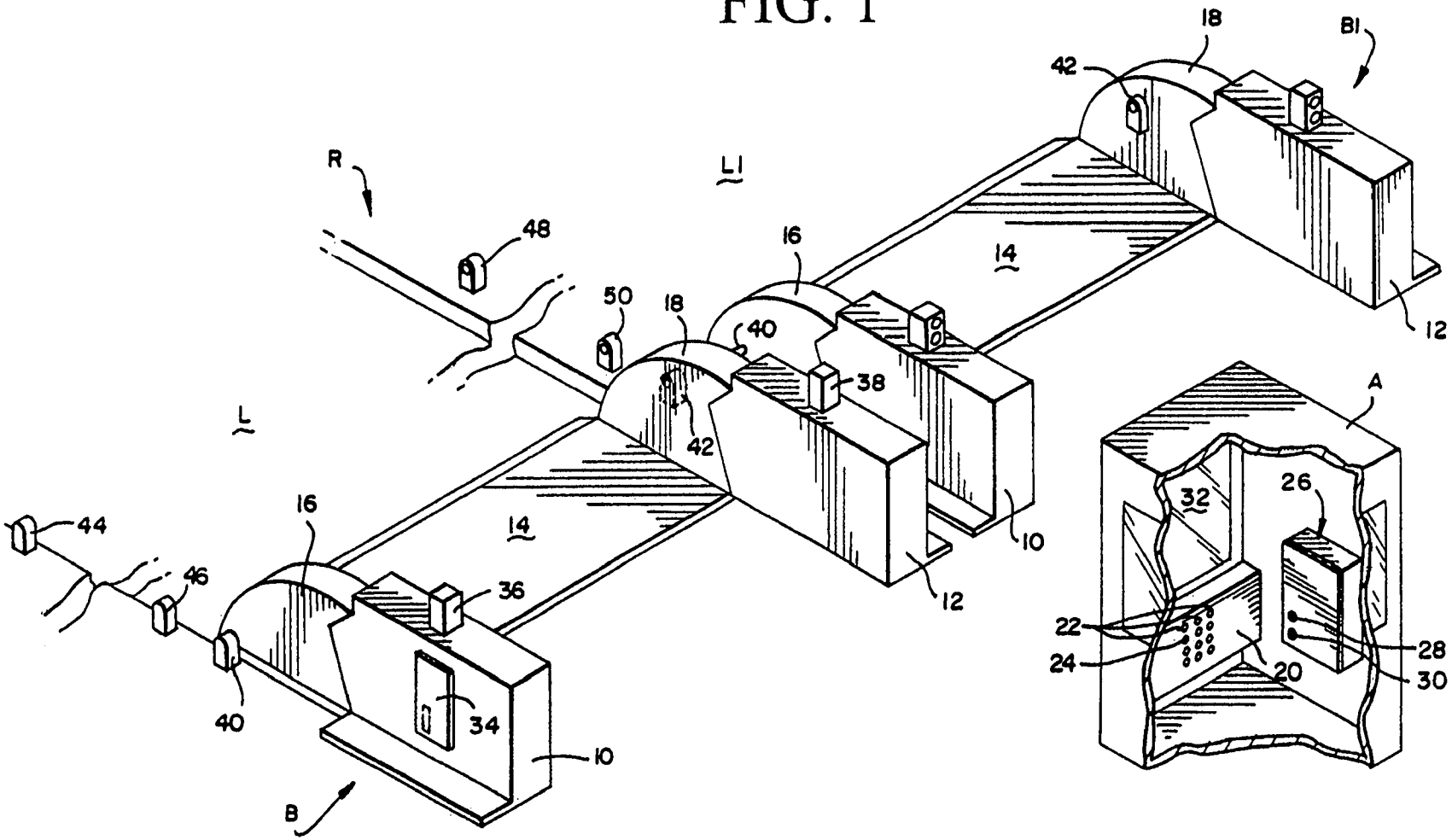
FIG. 1 is a fragmentary perspective view with portions cut away illustrating a vehicle barrier system according to an embodiment of the invention.

DETAILED DESCRIPTION OF PREFERRED EMBODIMENTS AND PREFERRED METHODS OF THE INVENTION

Reference will now be made in detail to the presently preferred embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

Barricades B and B1, as best shown in FIG. 1, are disposed across lanes L and L1 of roadway R. An attendant's booth A is disposed proximate barricades B and B1, preferably in visual association therewith, to permit monitoring of vehicles approaching barricades B and B1. While two barricades B and B1 are illustrated, those skilled in the art will understand that a greater or lesser number may be employed depending on the needs of the location to be controlled.

While a roadway R is disclosed, the barricades B and B1 are intended for blocking or interdicting the approach ramp to an underground garage, a vehicle entrance to a building, a vehicle entrance to a parking lot, a driveway, and the like. Optionally, barricades B and B1 may be portable and capable of being moved to any location where the necessity of stopping and preventing the further movement of a vehicle, particularly a vehicle loaded with explosives, is desired.

Barricades B and B1 each include side supports 10 and 12 which straddle an associated lane L and L1 of roadway R. Barrier plates 14 extend between side supports 10 and 12 and are pivotal between a lowered open position, wherein traffic may pass between supports 10 and 12, and a raised closed position, wherein traffic is obstructed from passing between supports 10 and 12. Preferably, the hydraulic cylinder and piston assembly for pivoting each barrier plate 14 is positioned within at least one and optionally both of supports 10 and 12. Cover plates 16 and 18 are secured to barrier plates 14 and extend from supports 10 and 12, respectively, to prevent unauthorized access to and tampering with the internally mounted cylinder and piston assembly.

Attendant's booth A includes a control panel 20 having a series of indicator lamps 22 and pushbuttons 24. Each indicator lamp 22 is operatively associated with some particular piece of operating equipment and is, preferably, continuously illuminated when that piece of equipment is operating. In this way, a non-illuminated lamp indicates that the corresponding piece of equipment is not operating, and is quickly perceivable with only a glance. Pushbuttons 24 have the function of initiating operation of equipment, or otherwise controlling some aspect of barricades B and B1 and the related equipment. Those skilled in the art will understand that control panel 20 will have more or fewer indicating lamps 22 and pushbuttons 24 than illustrated, depending upon the number of pieces of equipment being monitored and operated.

Control box 26 is also positioned within attendant's booth A and has key initiation and reset assemblies 28 and 30, each of which is operatively connected with the control system of one of barricades B and B1, for reasons to be explained. It should be understood that control box 26 may be positioned elsewhere, such as within the hydraulic enclosure. Similarly, key initiation and reset assemblies 28 and 30 may be positioned in alternative locations, such as on control panel 20. Attendant's booth A has windows 32 to permit visual monitoring of barricades B and B1. Preferably, attendant's booth A is locked and maintained secured in order to prevent unauthorized access to booth A, and to the equipment contained therein.

A remote control station 34 is mounted to one of supports 10 and 12 of each of barricades B and B1 for identifying an authorized vehicle and for producing a signal to lower barrier plate 14. Identification means may be any known device such as a card reader, digital keypad, laser vehicle identification system, radio control system, timers with magnetic vehicle detectors, or other devices that perform the same or similar function.

Remote control stations 34 are operatively connected to control panel 20 and control box 26 by appropriate lines, cables and the like, which are, preferably, underground. Alternatively, the connections may be wireless. Control stations 34 include switches or pushbuttons for causing operation of barrier plates 14. Preferably, switches or pushbuttons 24 of control panel 20 permit disabling of associated remote control panels 34, thereby preventing unauthorized pivoting of barrier plates 14 and assuring absolute control over the operation of barricades B and B1 from booth A.

Indicator lamps 36 and 38 are mounted atop supports 10 and 12, respectively, in order to provide a visual indication to an approaching vehicle of the position of associated barrier plate 14. For example, indicating lamps 36 and 38 may be continuously lit when associated plate 14 is in the raised position, whereas lamps 36 and 38 could be intermittently operated when associated plate 14 is in the lowered position. While lamps 36 and 38 are illustrated as being disposed atop each of supports 10 and 12, respectively, those skilled in the art will understand that lamps 36 and 38 may be mounted in some other location, and that fewer or additional lamps may be used.

Barrier plates 14 pivot into the lowered position, wherein plates 14 are parallel to and substantially coplanar with associated lanes L and L1, for permitting vehicles to pass between associated supports 10 and 12 and along roadway R. Detectors 40 and 42 monitor for the presence of a vehicle over the lowered barrier plate 14. Detectors 42 are operatively connected to control panel 20 and prevent the associated plate 14 from being pivoted into the raised position should a vehicle be present over plate 14. This prevents plate 14 from being damaged by and causing damage to a vehicle sitting or parked over lowered plate 14, thereby enhancing safety. Although only one detection system, 40 and 42, is illustrated in FIG. 1, those skilled in the art will understand that a system may be provided for each of barricades B and B1, or optionally may be omitted altogether.

Similar light sources 44 and 46 and detectors 48 and 50 are optionally disposed along roadway R in spaced apart relation for each of the lanes. Detectors 48 and 50 are operatively connected with control box 26 and permit the approach of a vehicle to be detected, as well as the speed of the vehicle to be ascertained. Speed of the vehicle may be determined because detectors 48 and 50 are a known distance apart, so that the time required to trip each of detectors 48 and 50 permits the speed of the approaching vehicle to be calculated by the control processor. These "loop detectors" can cause barrier 14 to pivot upwardly into the secure mode when a vehicle is approaching barrier 14, and can also pivot barrier 14 into the open mode after the vehicle has passed beyond barrier 14.

Figure 4:
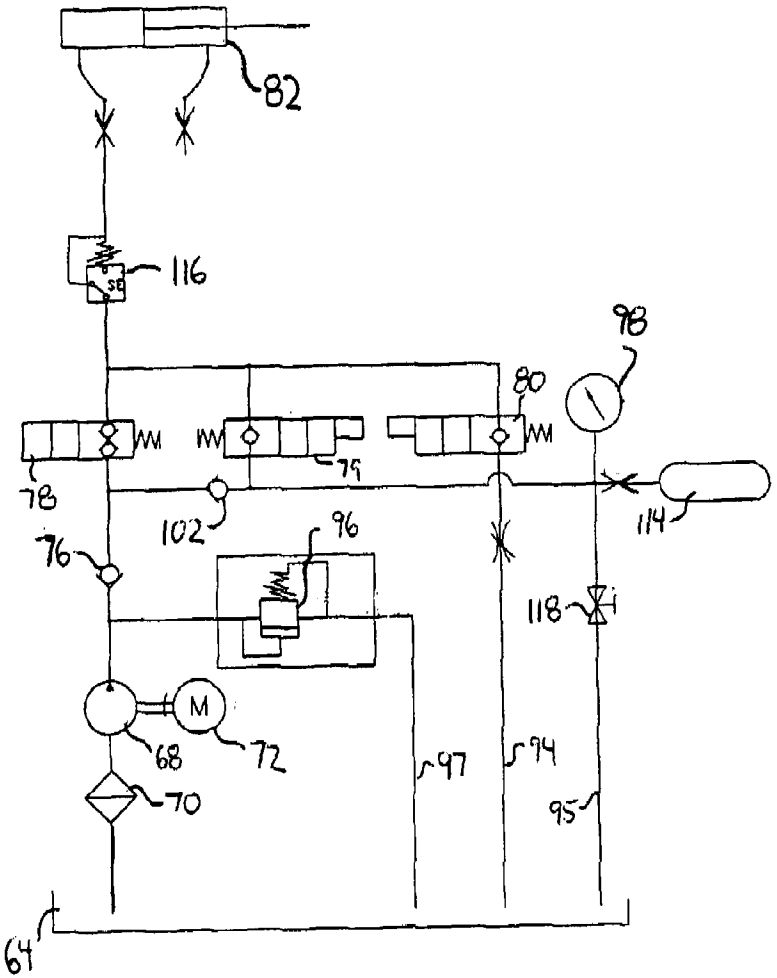
FIG. 4 is a schematic view of a hydraulic system of an embodiment of the invention.

FIG. 4 discloses a first embodiment of a hydraulic system used to operate the barricades B and B1 of FIG. 1. The hydraulic system optionally yet preferably is positioned within each of supports 10 and 12. As best shown in FIG. 4, hydraulic fluid reservoir 64 preferably has a capacity of at least 10 gallons of hydraulic fluid and, also, preferably includes a sight gage to permit the volume to be monitored. An electric heating coil or heat exchanger (not shown) optionally is positioned within reservoir 64 to maintain the fluid at a selected temperature, particularly when the barricade B is exposed to cold weather. The hydraulic fluid is preferably a petroleum based fluid, having a viscosity of 210 SSU at 100° F.

Positive displacement pump 68 communicates with the fluid in reservoir 64 through mesh strainer 70. Pump 68 is connected to electric variable speed direct current (DC) motor 72 through a coupling. Pump 68 preferably produces an output of about 0.5 gallons per minute in normal operation to raise the barrier plate 14 in about 4 to about 5 seconds in normal operation. Pump 68 is sized to accomplish, for example, four complete up/down cycles per minute when in normal operation mode. Preferably, DC motor 72 is a four horsepower, 24 Volt DC motor.

Check valve 76 is interposed between pump 68 and four-way two position directional control valves 78, 79, and 80 to prevent the back flow of fluid into pump 68. Valves 78 and 80 control barrier plate upward and downward movement, respectively, and valve 79 controls emergency up movement. The directional control valves 78, 79, and 80 are, preferably, capable of being operated by an electric solenoid which also has an incorporated operable mechanical plunger, as will be further explained. Electrical and mechanical capabilities are preferred because of the need to shift directional control valves 78, 79, and 80 in the event of a power failure, as well as from attendant's booth A during normal operation.

Electric DC motor 72 operates pump 68 which directs pressurized hydraulic fluid to cylinder and piston assembly 82. Although only a single cylinder and piston assembly 82 is illustrated, it should be understood that each of barricades B and B1 may have one or more additional cylinder and piston assemblies identical to assembly 82. Piston assemblies 82 are, preferably, respectively disposed adjacent supports 10 and 12 in order to permit easy pivoting of plates 14 and also to prevent plates 14 from being bent as could occur if only one cylinder and piston assembly was utilized. Preferably, a first set of valves 78, 79, and 80 is provided to control movement of first barricade B, and a second set of valves is provided to control movement of second barricade B1. Pump 68 also supplies pressurized fluid to accumulator 114, discussed in further detail below.

Return flow lines 94 and 95 are in flow communication with the directional control valves 78, 79, and 80 for exhausting hydraulic fluid to reservoir 64 during operation of cylinder and piston assembly 82. Pressure relief valve 96 is positioned on the input side of valve 76, and includes a flow line 97 that connects with reservoir 64 in order to vent fluid in an over pressure situation.

Pump 68 is in communication with accumulator 114 for charging and maintaining pressurized hydraulic fluid in accumulator 114. Check valve 102 is interposed between pump 68 and accumulator 114 for preventing the back flow of fluid into pump 68. Hydraulic accumulator 114 communicates with directional control valve 79 in order to provide a secondary passive supply of pressurized hydraulic fluid. Pressure switch 116 cooperates with gauge 98 to monitor the pressure of piston assembly 82 and accumulator 114, and operates DC motor 72 whenever the pressure in either piston assembly 82 or accumulator 114 falls below a selected level. In this way, DC motor 72 need not be in continuous operation, but is operated only when required to provide primary power for operating cylinder and piston assemblies 82, or when required to pressurize accumulator 114. Preferably, a drain valve 118 is in flow communication with accumulator 114 and with reservoir 64 in order to permit accumulator 114 to be drained as appropriate.

Figure 5:
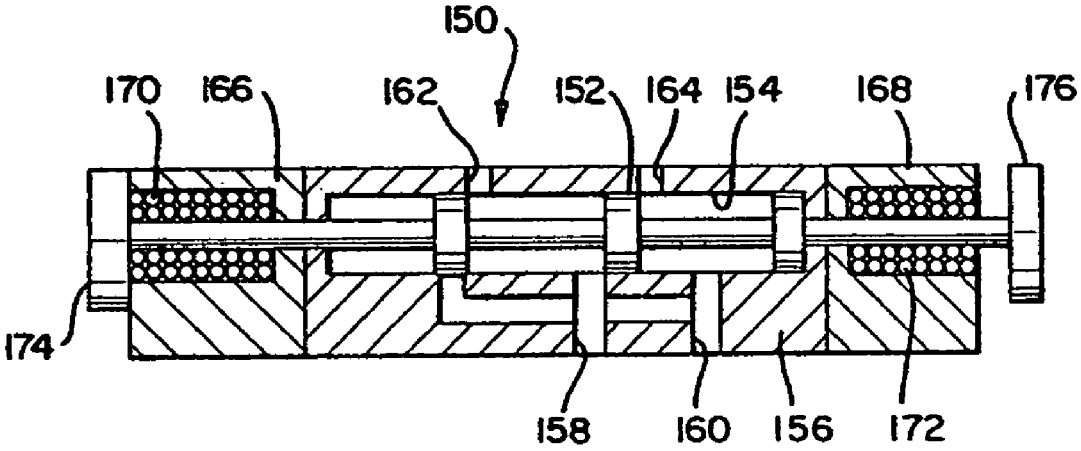
FIG. 5 is a cross-sectional view of a four-way two position solenoid controlled valve.

FIG. 5 discloses four-way two position valve assembly 150 which corresponds substantially to the valves 78, 79, 80. Spool 152 is slidably mounted within chamber 154 of body 156. Body 156 has ports 158, 160, 162 and 164 through which hydraulic fluid flows in response to the position of spool 152. C-frames 166 and 168 are mounted to the opposite ends of body 156. Electric coils 170 and 172 are mounted within frames 166 and 168, respectively. Plungers 174 and 176 pass through the respective coils and are connected with spool 152. Coils 170 and 172 are operatively connected with control panel 20 and with a source of electric power. Energization of a coil 170, 172 generates a field causing the plunger and thereby spool 152 to shift for routing the fluid through the ports.

Plungers 174 and 176 may also be manually operated. In the event of a power failure, application of a force, such as by a screwdriver or the like, will cause plunger 174, 176 to shift, and thereby spool 152. Therefore, valve assembly 150 may be remotely operated from attendant's booth A, or may be manually operated as required.

Figure 3:
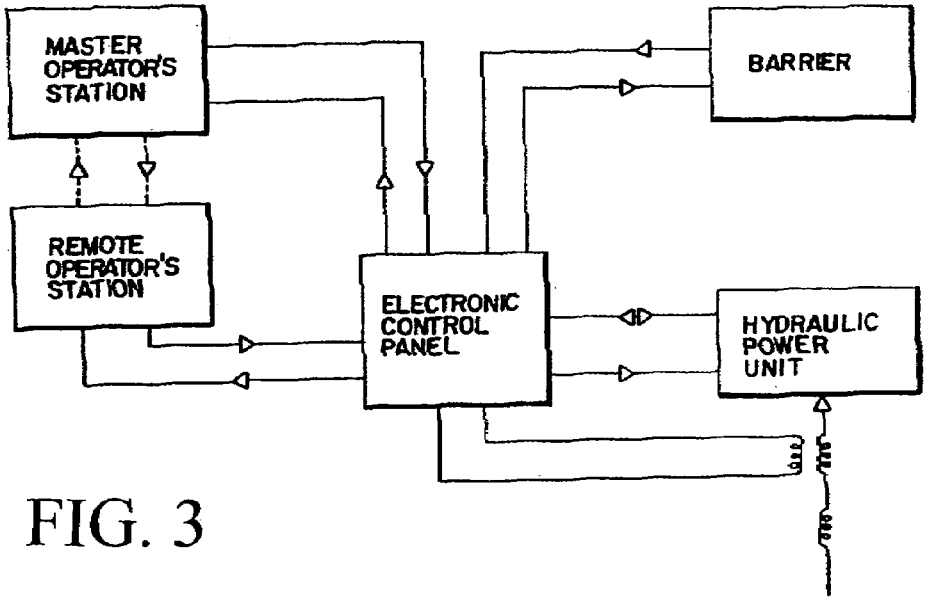
FIG. 3 is a schematic diagram illustrating a control system of the vehicle barrier system of FIG. 1.

FIG. 3 discloses the control system utilized in operating the barricades of the invention. FIG. 3 illustrates a single barricade configuration, although those skilled in the art can readily understand how the multiple barricade operation, such as illustrated in FIG. 1, can be adapted to the control scheme.

The electrical control panel, which corresponds to control box 26, is in operable communication with the remote operator's station and the master operator's station. The remote operator's station corresponds to remote control station 34, whereas the master operator's station corresponds to control panel 20. It can be noted that the remote operator's station communicates with the electronic control panel, as does the master operator's station, which similarly communicates with the remote operator's station. The result is that barrier plate 14 pivots in response to the first of the two operator's stations indicating that pivoting is necessary, unless one of the defined emergency conditions is present. In other words, the electronic control panel operates on a modified "first input" system, thereby assuring step by step processing of the input signals.

Similarly, the electronic control panel is in operative communication with the hydraulic power unit, and with the barriers and their associated position switches, indicating lamps, etc. It can be noted in FIG. 3 that the hydraulic power unit and barrier plate 14 each sends information to the electronic control panel, and receives information from the electronic control panel. It should be remembered that the hydraulic power unit of this embodiment includes a motor driven pump and an accumulator, and it is therefore desirable for the electronic control panel to ascertain the operational condition of the hydraulic power unit, such as operation of the DC motor, operation of the pump, power supplied to the motor and the like.

Figure 2:
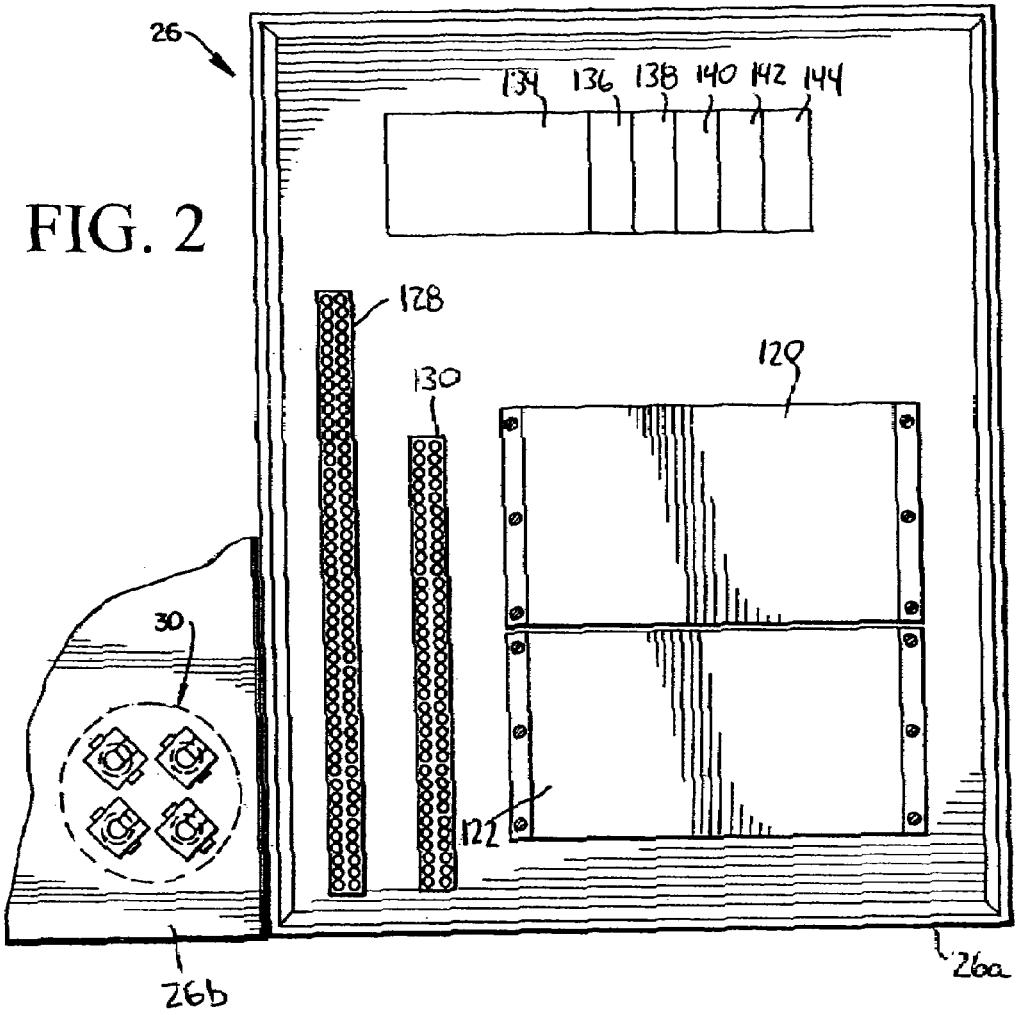
FIG. 2 is a fragmentary elevational view of a control box of the vehicle barrier system of FIG. 1

FIG. 2 illustrates control box 26 which is positioned within booth A. Cover 26*b* is hingedly connected to housing 26*a* and is secured to same, such as by a lock. Key initiation and reset assemblies 28 and 30 are mounted to cover 26*b*, only assembly 30 being illustrated in FIG. 2, and disable control panel 20 in the event of any one of a number of defined emergency conditions and also energize panel 20 upon initial start-up and after the emergency has been cleared. Assemblies 28 and 30 therefore prevent barriers 14 from being pivoted from remote control stations 34 and likewise prevent the operator from operating pushbuttons 24 to cause plates 14 to pivot, unless the resets have been energized. Assemblies 28 and 30, therefore, lock-out the barrier pivoting system and prevent unauthorized pivoting.

Programmable controller 134 is mounted within box 26 and performs the essential control monitoring operations for barricades B and B1. Controller 134 is an electronic device, of a type well known in the art, and avoids the needs for relays, overloads and the like which are required with conventional electrical systems. Controller 134 is a fully logic operated programmable device which allows for the highest level of safety, security, reliability and flexibility and is a stored program system.

A plurality of input/output devices 136, 138, 140, 142 and 144 are operatively connected to controller 134 and take the place of the relays and the like of conventional electrical systems. Programmable controller 134, in cooperation with the input/output devices 136, 138, 140, 142 and 144, provides a control system, illustrated in FIG. 4, which continuously monitors all pertinent operating elements of the barricades B and B1 and permits the guard to keep his attention focused on the approaching vehicles.

Device 136, preferably, monitors and controls the power supply, discussed in further detail below. Similarly, device 138 operates lamps 36 and 38, as well as motor starter for motor 72. Device 140, on the other hand, operates panel indicating lights 22, whereas device 142 is used in the hydraulic monitoring system and for controlling actuation of direction control valves 78, 79, and 80. Lastly, device 144 cooperates with detectors 40, 44, and 46.

Those skilled in the art will understand that the programmable controller 134, in conjunction with the related input/output devices, provides a control system which is expandable as options are added to barricades B and B1. Also, while it has been indicated that each of devices 136, 138, 140, 142, 144 is used for monitoring a particular function or operation, those skilled in the art will understand that each of the devices can be used to monitor or operate some other device or function.

As shown in FIG. 2, batteries or battery packs 120 and 122 are positioned within box 26 and provide a source of electric power for operating barrier system 10. It should be understood that the present embodiment may contain fewer or more batteries than the two batteries 120 and 122 that are illustrated. Also illustrated in FIG. 2, terminal strips 128 and 130 are positioned within box 26 and interconnect the various operating elements with programmable controller 134. Terminal strips 128 and 130 are of a type well known in the art and facilitate wiring of the various operating elements to controller 134.

Figure 6:
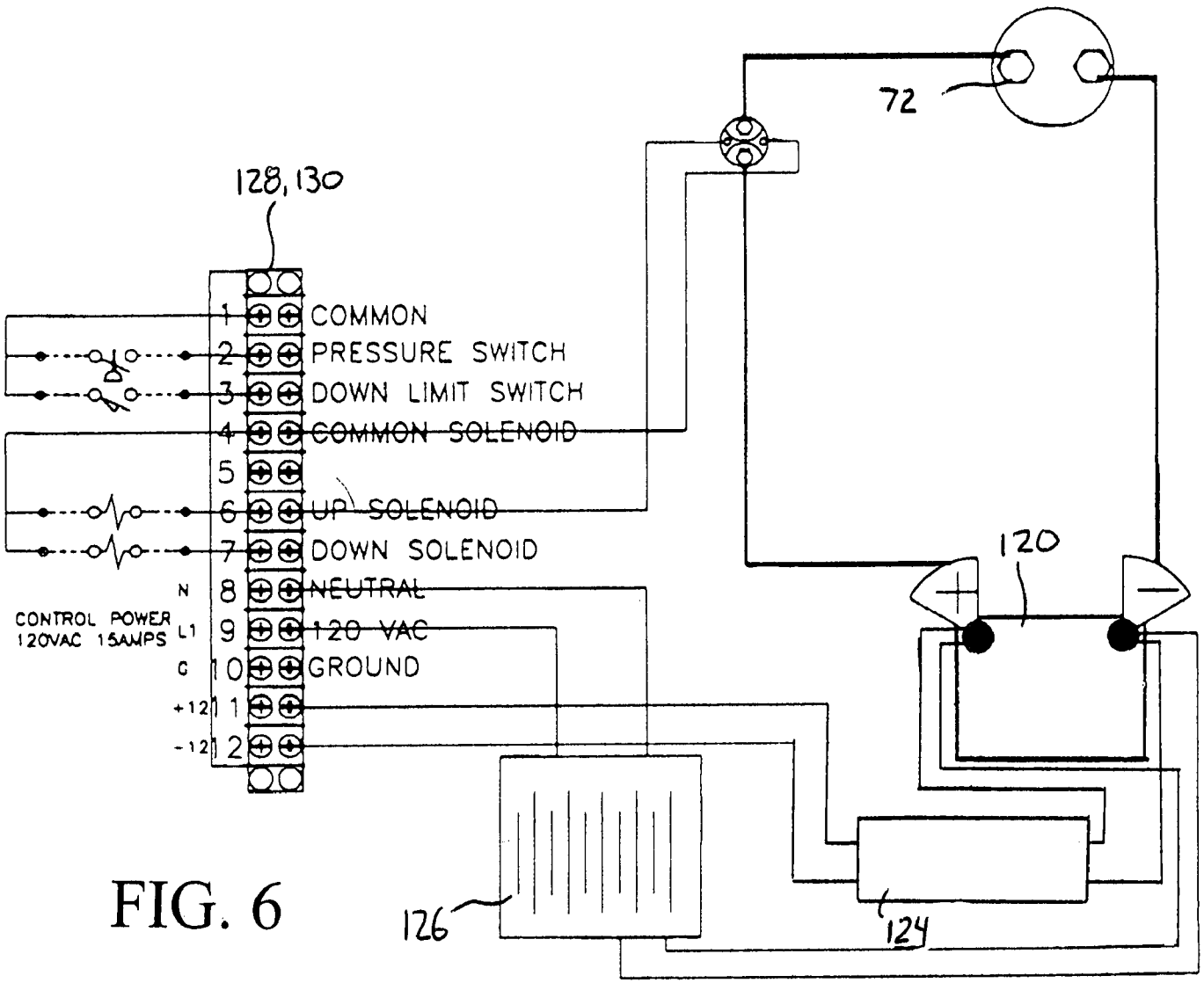
FIG. 6 is a schematic view of an electrical system suitable for operating the hydraulic system of FIG. 4.

FIG. 6 is an electrical diagram illustrating a single battery (or set of batteries) 120 electrically connected to terminal strips 128 and 130 for powering DC motor 72 to operate pump 68 and charge accumulator 114, and for energizing solenoids 78, 79, and 80 to permit barrier plate 14 to pivot in response to pressurized hydraulic fluid supplied by pump 68 and/or accumulator 114. Battery 120 is preferably yet optionally a 12V battery. Optionally, the electrical system is provided with an electric voltage booster/converter 124 for increasing voltage (e.g., doubling the voltage of the battery, i.e., 24V). An electric recharger 126 is provided for delivery a trickle charge to recharge battery 120 as needed. Recharger 126 is electrically connected to an alternating current AC power supply. Recharger 126 may have an AC plug for mating with an electrical wall outlet, etc.

In normal (or non-emergency) operation mode, battery 120 powers DC motor 72 to operate pump 68 and charge accumulator 114. Battery 120 also energizes solenoids 78, 79, and 80, and powers the control panel 20. The use of battery 120 as the primary power source in normal everyday operation advantageous affords additional security to the vehicle barrier system by eliminating the system's dependence on an outside source of alternating current power, which potentially could be vulnerable to attack by terrorists. As mentioned above, electric voltage booster 124 assists in meeting the power requirements for operating pump 68, accumulator 114, etc. Controller 134 activates system 10 in normal operation mode to open/close solenoids and operate pump 68 and other equipment so that sufficient hydraulic fluid, e.g., about 0.5 to about 2 gallons per minute, is supplied to cylinder and piston assembly 82 to pivot barrier plate 14 between the open and closed positions at a first operating speed. Preferably, it takes barrier plate 14 about 4 seconds to about 5 seconds to move from its open to its closed position, or vice versa, at the first operating speed.

Emergency operation mode may be implemented by either one of push button 24 or automatically via detectors 48 and 50. In an emergency operation mode, such as in the event of a vehicle charging towards lowered barrier plate 14, controller 134 activates hydraulic accumulator 114 to release stored, pressurized hydraulic fluid. The pressurized hydraulic fluid from accumulator 114 is supplied to cylinder and piston assemblies 82, either alone or in combination with hydraulic fluid supplied from pump 68, to move barrier plate 14 from the open position to a closed position at a second operating speed which is greater than the first operating speed. Preferably, at the second operating speed barrier plate 14 is moved from the open position to the closed position in less than one-half (½) of the time, and more preferably less than one-quarter (¼) of the time required to move barrier plate 14 from the open to closed position at the first operating speed. For example, preferably at the second operating speed barrier plate 14 moves from its closed to its open position or vice versa in about 1 second.

A second embodiment of the invention will now be described with reference to FIGS. 7 and 8. It should be understood that components and operations of this second embodiment are identical or substantially similar to those described above, except where otherwise noted. Like reference numerals are used to designate like parts and components. The hydraulic system of FIG. 7 is similar to that depicted in FIG. 4, except that hydraulic accumulator 114 and related directional control valve 79, and drain valve 118 have been eliminated.

Figure 7:
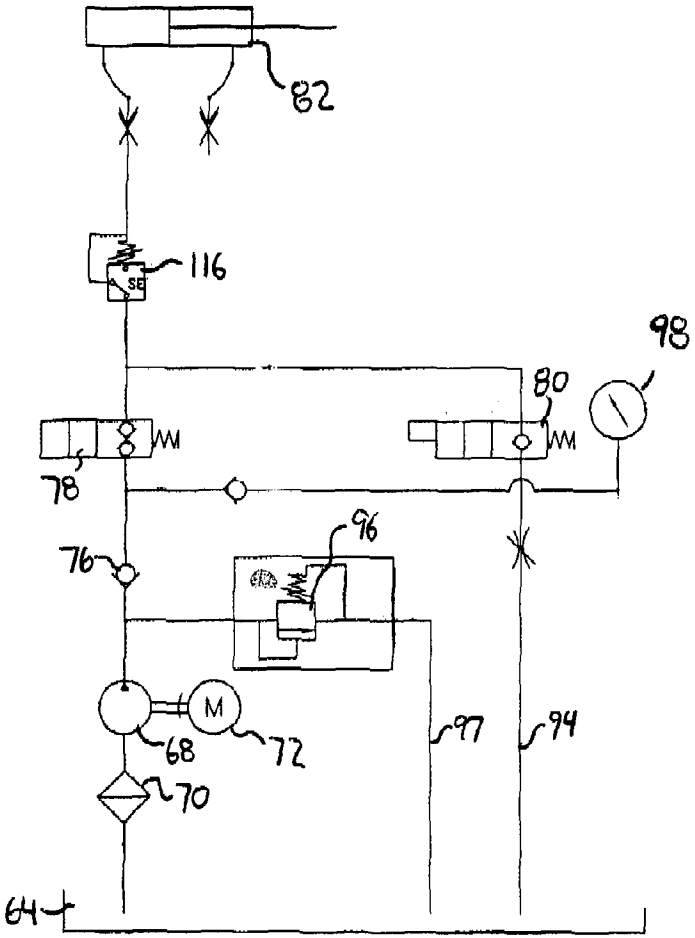
FIG. 7 is a schematic view of a hydraulic system of another embodiment of the invention.
Figure 8:
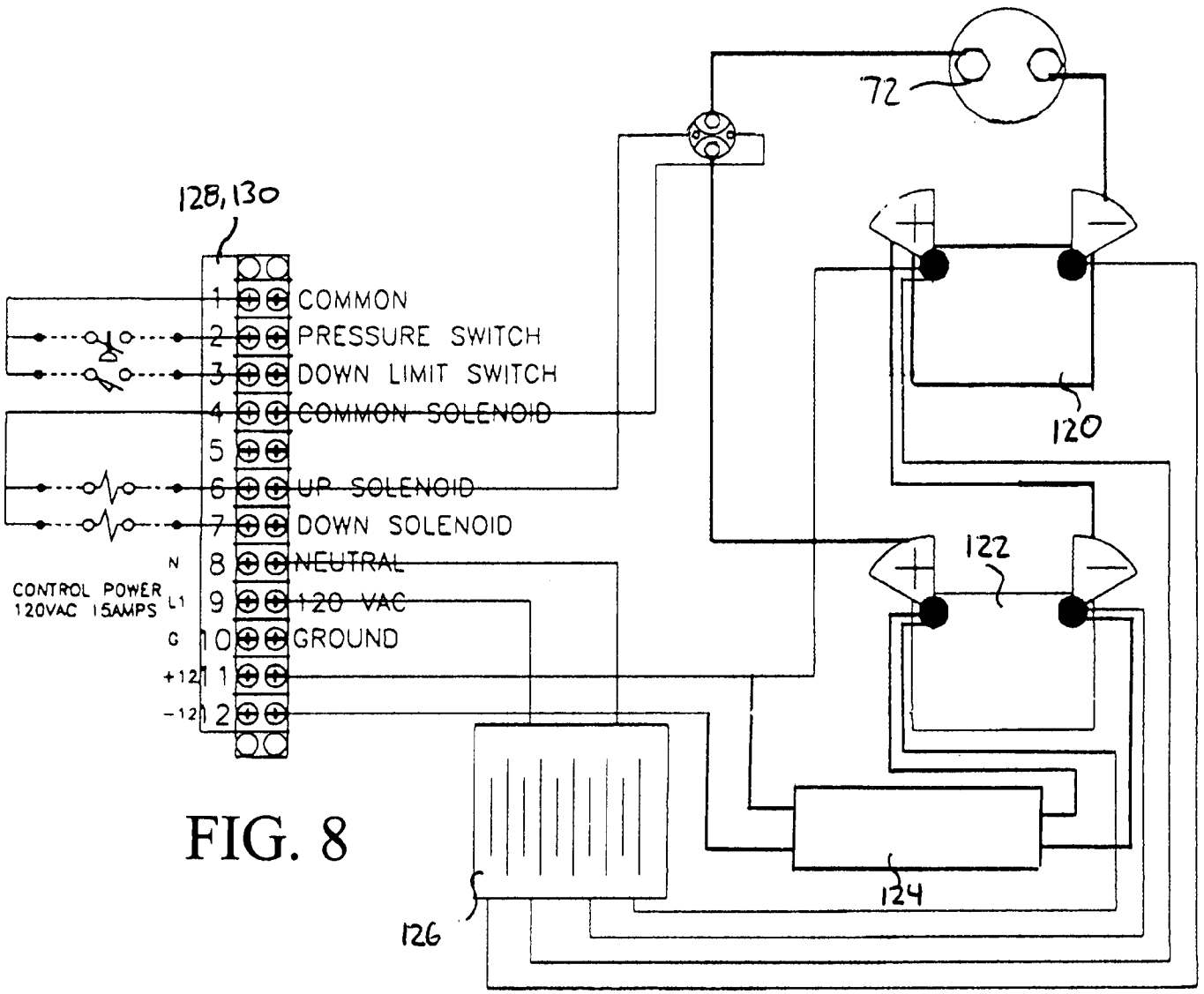
FIG. 8 is a schematic view of another embodiment of an electrical system suitable for operating the hydraulic system of FIG. 7.

FIG. 7 is an electrical diagram illustrating first battery 120 electrically connected to terminal strips 128, 130 for powering variable speed DC motor 72, which operates pump 68. First battery 120 preferably yet optionally is a 6 V rechargeable battery. Second battery 122 is electrically connected to terminal strips 128 and 130 for energizing solenoids 78, 80, for providing power to other components of system 10, other than DC motor 72, for permitting barrier plate 14 to pivot in response to pressurized hydraulic fluid supplied by pump 68. Battery 122 is preferably yet optionally a 12V battery optionally electrically connected to an electric voltage booster/converter 124 for increasing (e.g., doubling output to 24V) to meet the requirements of emergency operation mode. It should be understood that different voltage batteries may be used, and further than batteries 120 and 122 may provide electrical power to different combinations of components than those described above. An electric recharger 126 is provided for providing a trickle charge to batteries 120 and 122 as needed. Recharger 126 is electrically connected to an alternating current AC power supply.

In normal operation mode for the second embodiment, batteries 120 and 122 power DC motor 72 and the rest of the barrier system. Controller 134 activates system 10 to open/close solenoids 78, 80 and operate pump 68 and other equipment so that hydraulic fluid is supplied to cylinder and piston assemblies 82 at a sufficient rate, e.g., about 2 gallons per minute, to pivot barrier plate 14 between the open and closed positions at a first operating speed. At the first operating speed, barrier plate 14 preferably is moved from its open position to its closed position, or vice versa, in about 4 seconds to about 5 seconds.

Emergency operation mode for the second embodiment may be implemented by either one of push button 24 or automatically via detectors 48 and 50. In an emergency operation mode, such as in the event of a vehicle charging towards lowered barrier plate 14, controller 134 causes additional power to be drawn from battery 122 to operate variable speed DC motor 72 at a greater speed, including the fluid throughput of pump 68, such as to about 10 gallons per minute. The pressurized hydraulic fluid from pump 68, which is driven by DC motor 72 powered by either battery 122 alone or both batteries 120 and 122 (e.g., 18 V), is supplied to cylinder and piston assemblies 82 to move barrier plate 14 from the open position to a closed position at a second operating speed which is greater than the first operating speed. Preferably, at the second operating speed barrier plate 14 is moved from the open to closed position in less than one-half (½) of the time, and more preferably less than one-quarter (¼) of the time required to move barrier plate 14 from the open to closed position at the first operating speed. For example, preferably at the second operating speed barrier plate 14 moves from its closed to its open position or vice versa in about 1 second.

The use of batteries 120 and 122 as the primary power source in normal everyday operation imparts additional security to the vehicle barrier system of this second embodiment by eliminating reliance of the system on a potentially vulnerable outside source of alternating current power.

While this invention has been described as having a preferred design, it is understood that it is capable of further modifications, uses and/or adaptations of the invention, following in general the principle of the invention and including such departures from the present disclosure as come within known or customary practice in the art to which the invention pertains, and as may be applied to the central features hereinbefore set forth, and fall within the scope of the invention of the limits of the appended claims.

What is claimed is:

1. A vehicle barrier system positionable in a vehicular passageway for permitting selective obstruction of the vehicular passageway, comprising:

a security barricade movable between an open position for permitting passage of a vehicle through the vehicle barrier system and a closed position for obstructing passage of the vehicle through the vehicle barrier system;

a hydraulic actuator operatively connected to the security barricade for moving the security barricade between the open and closed positions;

a pump for supplying hydraulic fluid to the hydraulic actuator;

a DC motor for operating the pump;

a controller for controlling activation of the DC motor;

a battery for supplying power to the DC motor in a normal operation mode to operate the pump so that the hydraulic actuator may move the security barricade between the open and closed positions at a first operating speed; and a hydraulic accumulator for storing hydraulic fluid under pressure and supplying the stored, pressurized hydraulic fluid, either alone or in combination with hydraulic fluid supplied from the pump, to the hydraulic actuator in an emergency operation mode for moving the barricade between the open and closed positions at a second operating speed which is greater than the first operating speed.

2. The vehicle barrier system of claim 1, wherein in the emergency operation mode both the pump and the hydraulic accumulator collectively provide the hydraulic fluid to the hydraulic actuator for moving the security barricade at the second operating speed.

3. The vehicle barrier system of claim 1, further comprising an electric voltage booster for doubling the power output of the battery.

4. The vehicle barrier system of claim 1, wherein the battery and the pump cooperate to charge the hydraulic accumulator with hydraulic fluid.

5. The vehicle barrier system of claim 1, wherein the battery is rechargeable and includes primary and secondary batteries, and wherein the system further comprises a recharging source for recharging the primary and secondary batteries.

6. The vehicle barrier system of claim 1, wherein the battery comprises a plurality of rechargeable batteries.

7. The vehicle barrier system of claim 1, wherein the battery comprises a 12 Volt battery.

8. The vehicle barrier system of claim 1, wherein at the second operating speed the security barricade is moved from the open position to the closed position in less than one-half of the time required to move the security barricade from the open position to the closed position at the first operating speed.

9. The vehicle barrier system of claim 1, wherein at the second operating speed the security barricade is moved from the open position to the closed position in less than one-quarter of the time required to move the security barricade from the open position to the closed position at the first operating speed.

10. The vehicle barrier system of claim 1, wherein at the second operating speed the security barricade moves from the open position to the closed position in no more than about 1 second.

11. A method for operating the vehicle barrier system of claim 1, comprising:

supplying power from the battery to the DC motor in the normal operation mode to operate the pump to provide hydraulic fluid to the hydraulic actuator so that the hydraulic actuator moves the security barricade between the open and closed positions at the first operating speed; and supplying the stored, pressurized hydraulic fluid from the hydraulic accumulator, either alone or in combination with hydraulic fluid supplied from the pump, to the hydraulic actuator in the emergency operation mode for moving the barricade between the open and closed positions at the second operating speed.

12. A vehicle barrier system positionable in a vehicular passageway for permitting selective obstruction of the vehicular passageway, comprising:

a security barricade movable between an open position for permitting passage of a vehicle through the vehicle barrier system and a closed position for obstructing passage of the vehicle through the vehicle barrier system;

a hydraulic actuator operatively connected to the security barricade for moving the security barricade between the open and closed positions;

a pump for supplying hydraulic fluid to the hydraulic actuator;

a DC motor for operating the pump;

a controller for controlling activation of the DC motor;

a primary battery for supplying power to the DC motor in a normal operation mode to operate the pump so that the hydraulic actuator may move the security barricade between the open and closed positions at a first operating speed; and a secondary battery for supplying auxiliary power to the DC motor in an emergency operation mode so that the auxiliary power, alone or in combination with the power supplied by the primary battery, is sufficient to operate the pump in a manner that causes the hydraulic actuator to move the security barricade between the open and closed positions at a second operating speed which is greater than the first operating speed.

13. The vehicle barrier system of claim 12, wherein the system excludes a hydraulic accumulator.

14. The vehicle barrier system of claim 12, wherein in the emergency operation mode both the primary and secondary batteries collectively supply power to operate the pump at a sufficient rate to supply the hydraulic fluid to the hydraulic actuator for moving the security barricade at the second operating speed.

15. The vehicle barrier system of claim 12, further comprising an electric voltage booster for doubling the power output of the secondary battery.

16. The vehicle barrier system of claim 12, wherein the primary and secondary batteries are rechargeable, and wherein the system further comprises a recharging source for recharging the primary and secondary batteries.

17. The vehicle barrier system of claim 12, wherein the primary battery comprises a rechargeable 6 Volt battery, and wherein the secondary battery comprises a rechargeable 12 Volt battery.

18. The vehicle barrier system of claim 12, wherein at the second operating speed the security barricade is moved from the open position to the closed position in less than one-half of the time required to move the security barricade from the open position to the closed position at the first operating speed.

19. The vehicle barrier system of claim 12, wherein at the second operating speed the security barricade is moved from the open position to the closed position in less than one-quarter of the time required to move the security barricade from the open position to the closed position at the first operating speed.

20. The vehicle barrier system of claim 12, wherein at the second operating speed the security barricade moves from the open position to the closed position in no more than about 1 second.

21. A method for operating the vehicle barrier system of claim 12, comprising:

supplying power from the primary battery to the DC motor in the normal operation mode to operate the pump to provide hydraulic fluid to the hydraulic actuator so that the hydraulic actuator moves the security barricade between the open and closed positions at the first operating speed; and supplying the auxiliary power from the secondary battery, either alone or in combination with the power supplied by the primary battery, to the DC motor to operate the pump so that the hydraulic actuator is provided with hydraulic fluid in the emergency operation mode for moving the barricade between the open and closed positions at the second operating speed.

22. A vehicle barrier system positionable in a vehicular passageway for permitting selective obstruction of the vehicular passageway, comprising:

a security barricade movable between an open position for permitting passage of a vehicle through the vehicle barrier system and a closed position for obstructing passage of the vehicle through the vehicle barrier system;

a hydraulic actuator operatively connected to the security barricade for moving the security barricade between the open and closed positions;

at least one hydraulic fluid source for providing hydraulic fluid to the hydraulic actuator; and a controller for controlling the at least one hydraulic fluid source to operate so that in a normal operation mode the security barricade is moved by the hydraulic actuator between the open and closed positions at a first operating speed and for controlling the at least one hydraulic fluid source to operate so that in an emergency operation mode the barricade is moved by the hydraulic actuator between the open and closed positions at a second operating speed which is greater than the first operating speed.

* * * * *